US007363738B2

(12) United States Patent
Burtch

(10) Patent No.: US 7,363,738 B2
(45) Date of Patent: Apr. 29, 2008

(54) PLANAR DISPLAY DEVICE WITH SLIDING REVEAL MEMBER OR MEMBERS

(76) Inventor: Richard Burtch, 3075 14th Ave., Suite 213, Markham, Ontario (CA) L3R 0G9

( * ) Notice: Subject to any disclaimer, the term of this patent is extended or adjusted under 35 U.S.C. 154(b) by 389 days.

(21) Appl. No.: 10/869,841

(22) Filed: Jun. 18, 2004

(65) Prior Publication Data

US 2005/0278997 A1 Dec. 22, 2005

(51) Int. Cl.
*G09F 11/00* (2006.01)

(52) U.S. Cl. ..... 40/491; 40/375; 116/324; 235/70 R; 434/405

(58) Field of Classification Search ..... 40/491, 40/375; 116/321, 322, 323, 324; 235/70 R; 434/405

See application file for complete search history.

(56) References Cited

U.S. PATENT DOCUMENTS 1,008,195 A * 11/1911 Prichard ..... 222/179.5
1,603,592 A * 10/1926 Glasner ..... 446/147
1,666,337 A * 4/1928 McDade ..... 434/348
2,064,749 A * 12/1936 Huber ..... 40/491
2,319,519 A * 5/1943 Rosaire ..... 434/405
2,335,713 A * 11/1943 Vogel ..... 40/109
2,746,188 A * 5/1956 Sweetnam ..... 40/614
5,285,589 A * 2/1994 Hyatt ..... 40/375
6,061,938 A * 5/2000 Young ..... 40/490
6,237,265 B1 * 5/2001 Crowell ..... 40/491
2003/0005611 A1 * 1/2003 Carlin ..... 40/491

* cited by examiner

*Primary Examiner*—Gary C. Hoge
(74) *Attorney, Agent, or Firm*—Stites & Harbison PLLC; Ross F. Hunt, Jr.

(57) ABSTRACT

Display devices for, e.g., advertising purposes, are provided wherein at least one member slides relative to at least one other member to a "reveal" position so as to display new and different information. In one embodiment, two sheath members move relative to a slide member while in another, two slide members move relative to a sheath member. In another embodiment, cutouts or windows are provided which reveal different information in different positions of the movable member or members of the device.

16 Claims, 3 Drawing Sheets

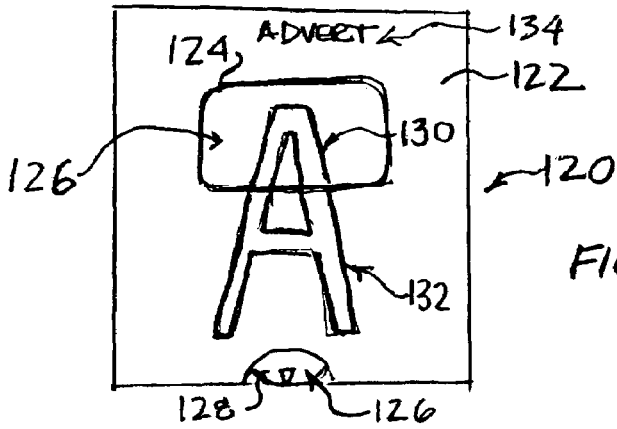
FIG. 5
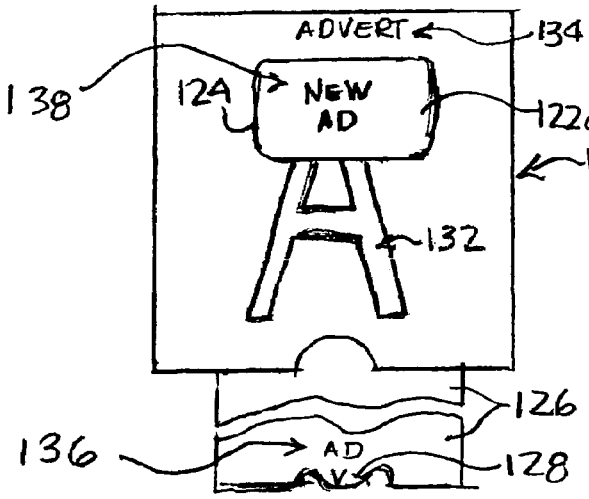
FIG. 6
FIG. 9
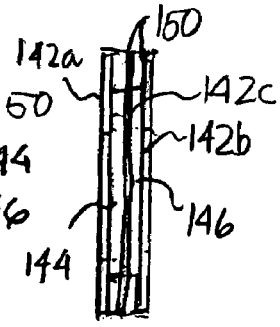
FIG. 7
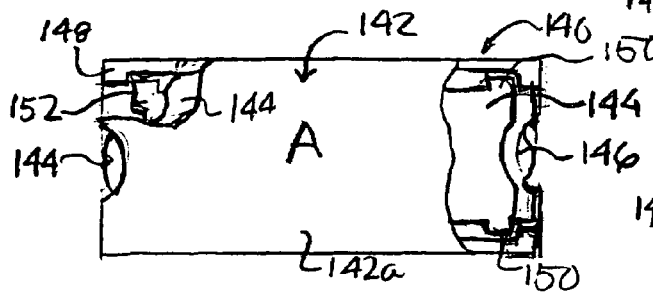
FIG. 8
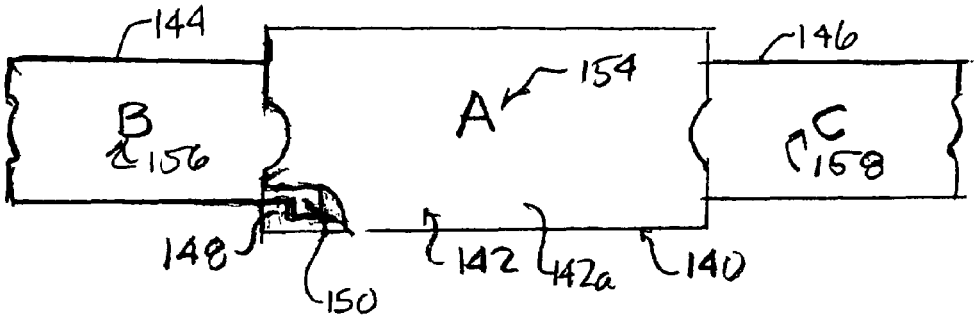

PLANAR DISPLAY DEVICE WITH SLIDING REVEAL MEMBER OR MEMBERS

FIELD OF THE INVENTION

The present invention relates to inexpensive display devices made of paper, cardboard, paperboard and the like used in displaying information such as advertising copy and pictorials, and, more particularly, to a device of this kind which includes at least one sliding portion movable to an exposed or "reveal" position in a manner which enhances the presentation of information.

BACKGROUND OF THE INVENTION

In my U.S. Pat. No. 6,290,060, I have disclosed a carrier device for planar items such as compact discs (CDs), credit cards and the like, and a blank for making the device, which afford important advantages over the prior art. The device and thus, of course, the blank, are made of paper, cardboard, paperboard, laminates of the same, and like materials, and the device is completely constructed from a single blank so that the device is very simple and inexpensive to make. Despite its simplicity and low cost, the device of the patent provides a highly effective carrying and display and/or dispensing functions wherein a planar item such as a CD, credit card or the like is shielded and protected within a cover or sheath in a carrying or storage mode, and can be readily exposed for display or dispensing purposes by pulling out or pushing out a sliding carrier member or tray which is disposed within the cover or sheath and which is adapted to carry the planar item.

In accordance with one aspect of the patent, there is provided a carrier device for a planar item, the device comprising: a cover sheath formed by first and second panels secured together so as to define a space therebetween; and a carrier member slidably received in said space for sliding movement between a storage position wherein the carrier member is nested within the sheath and a dispensing and/or display position wherein the carrier member extends outwardly of the sheath so that a planar item carried by the carrier member is displayed and can be removed from the device, the carrier member being formed by third and fourth panels secured together, the third panel comprising an opening therein for receiving a planar item to be carried, and the device further comprising stop means for limiting the sliding movement of the carrier member.

In an important implementation of the carrier device of the patent, the sheath includes first and second inner side walls defining a channel in which the carrier member slides, and the above-mentioned stop means comprises first and second projections on opposite sides of the carrier member, and first and second projections on said inner side walls which project inwardly into the channel from the inner side walls from opposite sides of the channel and which cooperate with the projections of the carrier member to limit the sliding movement of the carrier member.

SUMMARY OF THE INVENTION

In accordance with the present invention, display devices are provided which are made of materials similar to those used in the carrier device discussed above, i.e., paper, cardboard, paperboard, and the like. However, in contrast, the display devices of the invention are used to present information such as advertising copy and pictorials in a unique and highly appealing manner. Multiple embodiments of the display devices are provided each of which has special features.

In accordance with one aspect of the invention, there is provided a display device comprising:

a planar sheath member including first and second panels secured together so as to define a space therebetween; and a slide member disposed in said space and movable between a first position wherein the slide member is substantially wholly received within said space and a second position wherein at least a portion of said slide member extends outwardly beyond the sheath member, the sheath member including first and second inner side walls defining a channel in which said slide member slides and first and second stops extending into said channel from opposite sides of said side walls, and said slide member including first and second stop elements on opposite sides thereof for, upon movement of said slide member to said second position, engaging said stop elements of said sheath member to limit sliding movement of the slide member, the sheath including at least one window in the first panel of said sheath through which a facing portion of the slide member can be viewed in the first position of the slide member, and through which a facing portion of the second panel of the sheath member can be viewed, said facing portion of said slide member including information thereon which is displayed in the first position of said slide member, and said facing portion of said sheath member both including information thereon which is displayed in the second position of said slide member.

In one implementation, the information displayed by the respective facing potions is content related.

In another implementation, the information displayed by the respective facing portions relates to a common theme.

In one preferred embodiment, the first panel displays information which complements information displayed by the facing portion of said slide member.

In a further preferred embodiment, the first panel displays information which completes information displayed by the facing portion of said slide member.

Advantageously, the information displayed by the first panel and the information displayed by the facing portion of the slide member comprises pictorial information.

In another preferred embodiment, the first panel displays information which complements information displayed by the facing portion of said sheath member.

In yet another preferred embodiment, the first panel displays information which completes information displayed by the facing portion of said sheath member. Advantageously, the information displayed by the first panel and the information displayed by the facing portion of the sheath member comprises pictorial information.

Preferably, said first panel and said slide member both display further information.

In another important implementation, said at least one window comprises at least first and second spaced windows wherein different facing portions of said slide member can be viewed through said first and second windows in the first position of said slide member, and different facing portions of the second panel can be viewed through said first and second windows in the second position of said slide member.

In accordance with a further aspect of the invention, there is provided a display device comprising:

a slide member;

first and second planar sheath members each including first and second panels secured together so as to define a space therebetween for receiving a portion of said slide member, said sheath members being movable between first abutting positions wherein said slide member is substantially wholly received within said sheath members and second spaced positions wherein a central portion of said slide member is exposed between said sheath members, the sheath members each including first and second inner side walls defining a channel in which said slide member is received and first and second stops extending into said channel from opposite sides of said side walls, and said slide member including first and second stop elements on opposite sides thereof, at opposite ends thereof, for, upon movement of said sheath members to said second positions, engaging said stop elements of said sheath members so as to limit sliding movement of the sheath members, the sheath members including information that continues from the first sheath member to the second sheath member and said slide member including related information that is revealed in the second positions of said sheath members.

In one implementation, said information displayed by the sheath members and the slide member is content related.

In another implementation, the information displayed by the sheath members and the slide member relates to a common theme.

Preferably, the sheath member displays information which complements information displayed by said slide member.

In accordance with yet another aspect of the invention, there is provided a display device comprising:

a planar sheath member including first and second panels secured together so as to define a space therebetween; and first and second slide members disposed in said space, said first slide member being movable between a first position wherein first said slide member is substantially wholly received within said space and a second position wherein at least a portion of said first slide member extends outwardly beyond said sheath member, and said second slide member being movable between a first position wherein said second slide member is substantially wholly received within said space and a second position wherein at least a portion of said second slide member extends outwardly beyond said sheath member, said sheath member including first and second inner side walls defining a channel in which said slide members slide and further including, at each of the opposite ends of said channel, first and second sets of first and second stops extending into said channel from opposite sides of said side walls, and said first and second slide members each including first and second stop elements on opposite sides thereof for, upon movement of said slide members to said second position, engaging said stop elements of respective ones of said first and second sets of said stop elements to limit sliding movement of the corresponding slide member, said sheath member including information thereon and said first and second slide members each including related information thereon which is revealed in the second positions of said slide members.

In one implementation, the sheath member displays information which completes information displayed by the slide members.

In another implementation, the sheath member displays information which complements information displayed by the slide members.

In one preferred embodiment, the information displayed by the sheath member and the information displayed by the slide members includes pictorial information.

Further features and advantages of the present invention will be set forth in, or apparent from, the detailed description of preferred embodiments thereof which follows.

BRIEF DESCRIPTION OF THE DRAWINGS

FIGS. 5 and 6 are top plan views, partially broken away, of a display device in accordance with another preferred embodiment of the invention, showing the device in two different states thereof;

FIGS. 7 and 8 are top plan views, partially broken away, of a display device in accordance with yet another preferred embodiment of the invention;

FIG. 9 is an end elevational view of the embodiment of FIGS. 7 and 8.

DESCRIPTION OF THE PREFERRED EMBODIMENTS

Figure 1:
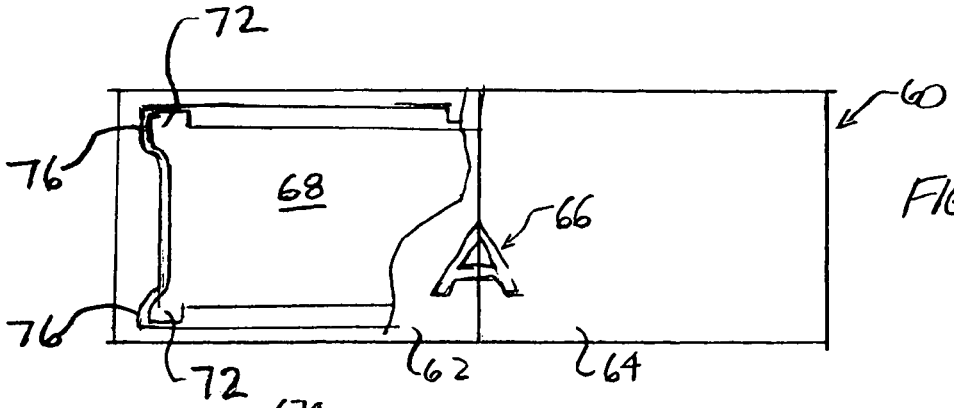
FIGS. 1 and 2 are top plan views, partially broken away, of a display device in accordance with a first preferred embodiment of the invention, showing the device in two different states thereof.
Figure 2:
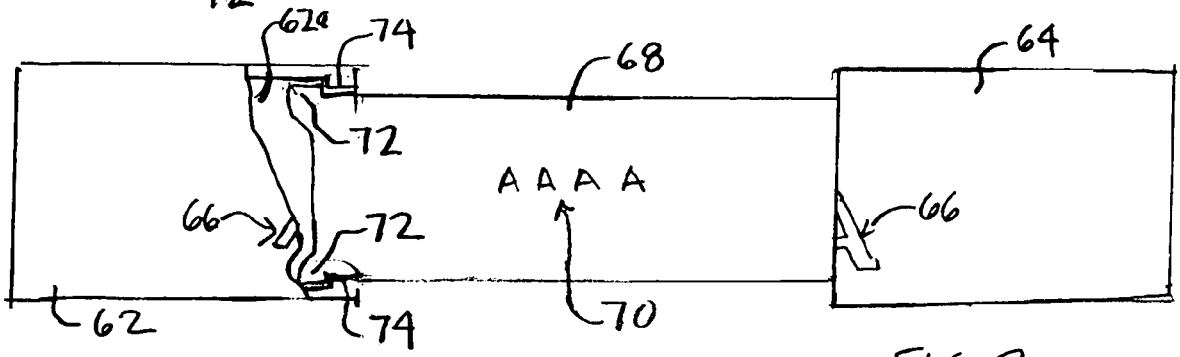

Referring to FIGS. 1 and 2, there is shown a first embodiment of the present invention. In this embodiment, a display device 60 is provided which includes a pair of sheath or panel members 62 and 64 which, in a first position, are disposed adjacent to one another to form a single display for advertising or other information. As shown at 66, which indicates a large letter "A," in a preferred implementation of this embodiment the information extends over both panels, i.e., both panels contribute a portion of the information and are used together to present the full information. It will, of course, be understood that the information (e.g., in the form of advertising words on a background illustration) would typically fill up both panel surfaces.

As indicated in the broken away portions of FIG. 1 and is shown more clearly in FIG. 8, a slide member or display member 68 is housed within members 62 and 64 which is, in some ways, similar to carrier member of the devices disclosed in U.S. Pat. No. 6,290,060, but, which, among other differences, is not adapted to carry, and does not carry, a CD or like planar item, in the illustrated implementation of the embodiment of FIGS. 1 and 2. Slider member 68 instead functions to also present information (e.g., advertising material) as indicated at 70 in FIG. 2, when panel members 62 and 64 are pulled apart to reveal information 70. In an important implementation, the information 70, represented by "AAAA" in FIG. 2, is related to the information 66 so that the two together provide a related message or present a related theme, consistent with the focal point, selling point or key information of the overall message or theme being presented by device 60.

As indicated in the broken away portions of FIGS. 1 and 2, slider member 68 includes stops at both ends thereof, with only stops 72 at the left end, as viewed in the figures, being illustrated in FIGS. 1 and 2.

Sheaths 62 and 64 both include cooperating stops at the facing portions thereof, with only stops 74 for sheath member 62 being shown in FIGS. 1 and 2. Sheaths 62 and 64 both include front and back panels or walls (with the back wall for sheath 62 being indicated at 62*a* in FIG. 8) and stops 74 are disposed between these front and back panels in a manner similar to that described in the above-mentioned U.S. Pat. No. 6,290,060. Recesses 76 of a shape corresponding to that of stops 72 of slider member 68 may be provided for receiving stops 72 in the closed position of sheath members 62 and 64, as shown for sheath member 62 in FIG. 1.

It will be understood from the foregoing that when sheath members 62 and 64 are pulled apart so as to slide away from each other along slide member 68, their travel is limited by the interaction between stops 72 and 74 as shown in FIG. 8. Stops 72 and 74 also prevent sleeve members 62 and 64 from separating from slide member 68 in the opened or "reveal" mode shown in FIG. 2.

Figure 3:
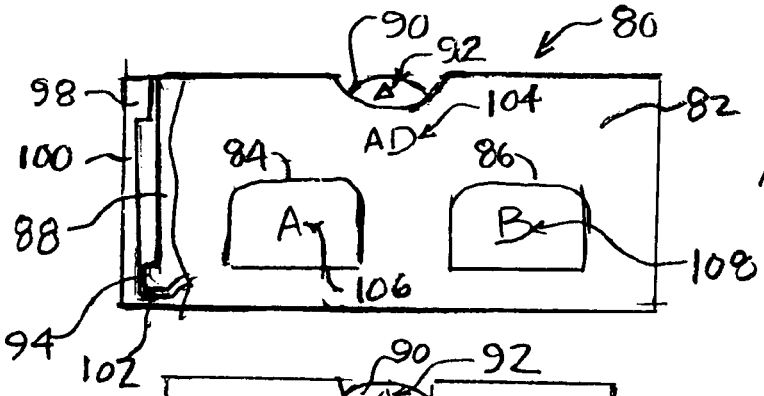
FIGS. 3 and 4 are top plan views, partially broken away, of a display device in accordance with a further preferred embodiment of the invention, showing the device in two different states thereof.
Figure 4:
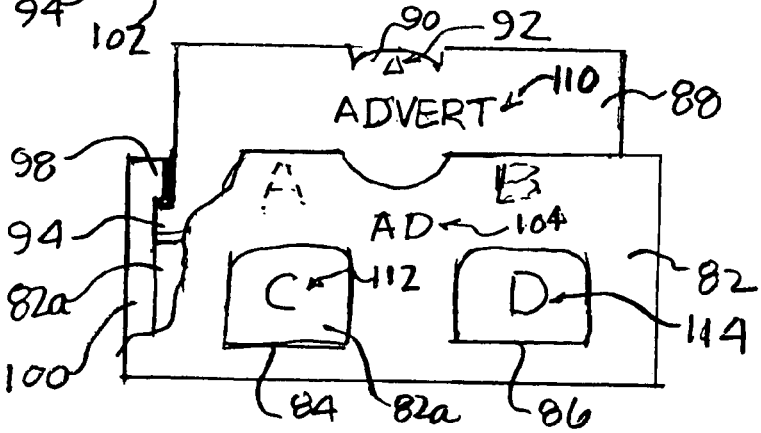

Referring to FIGS. 3 and 4, a further embodiment of the invention is shown. In this embodiment, a display device 80 includes a sheath member 82 having a pair of openings or cutouts 84 and 86 therein. Although two cutouts 84 and 86 are shown, it will be appreciated that three or more cutouts could be used, and also that a single cutout can be used (as in the embodiment of FIGS. 5 and 6 discussed below).

A slide member 88 is received between the panels or walls of sheath member 82 (a back panel or wall is indicated at 82*a*) and slides therein to a "reveal" or "display" position shown in FIG. 4. Slider member includes a central pull tab 90 with a directional indicator 92 at the upper edge thereof as viewed in FIGS. 3 and 4, as well as stops at opposite lower ends thereof, one such stop, denoted 94, being shown in FIGS. 3 and 4.

Stops are formed within sheath 82, on opposite sides thereof, at the upper end thereof as viewed in FIGS. 3 and 4, with one stop, denoted 98, being shown in the figures. The stop-forming intermediate portion or panel 100 of sheath member 82 may also include a recess 102 which is shaped to receive stop member 94 of slider member 88.

The operation of the device 80 is somewhat similar to that of device 60 of FIGS. 1 and 2 except, of course, that slide member 88 simply moves in and out of sleeve member 82, between the positions shown in FIGS. 3 and 4. Stops corresponding to stops 98 and 94 limit the travel of slider member 88 and prevent slide member 88 from separating from sleeve member 82 as described above.

In accordance with one important feature of this embodiment, sleeve or sheath member 82 includes information the front face thereof, which is indicated at 104 and representing by "AD," while slide member 88 includes two (in this case) related information items indicated at 106 and 108, and represented by "A" and "B," which are viewable through cutouts 84 and 86. Further, when slider member is moved to the "reveal" or exposed position shown in FIG. 4, related information carried thereby, which is denoted 110 and represented by "ADVERT," is exposed or revealed. In addition, further related information items indicated at 112 and 114, respectively, and represented by "C" and "D," provided on the forwardly facing surface of back wall 82*a* of sheath 82 are also revealed. As indicated above, all of the information presented is preferably related and, for example, the information 104 could be about, or related to, a television shown (and could, for example, pose a question about the show), with information items 106 and 108 being pictures of two of the stars or members of the cast of the show. In this example, information item 110 could provide further information (and could, for example, provide an answer to the question posed by information 104), while information items 112 and 114 could be pictures of further stars or cast members.

Referring to FIGS. 5 and 6, there is shown an embodiment of the invention. This embodiment is similar to that of FIGS. 3 and 4 and, in this regard, the device, which is generally denoted 120, includes sheath 122 with a cutout or window 124 therein, as well as a slide member 126 having a pull tab 128. In accordance with an important feature of this embodiment, the slide member 126 includes information 130 which complements or completes information 132 on the face of the sleeve member 122. This is indicated in FIG. 5 by parts of the letter "A" being formed by information segments 130 and 132. As indicated at 134, and represented by the word "ADVERT," sheath 122 can, of course, include further information at various locations thereon or can, for example, be a fully covering illustration including advertising material. In the latter example, the advertising could, for example, be for a movie or television show and the information 130 and 132 could, together, form a picture of a star or cast member.

Further related information, indicated by information 136 on slide member 126 and represented by "AD," and information 138 on the back wall 122*a* of sheath member 122 and represented by the words "NEW AD," is presented when slide member 126 is pulled out of sheath member 122. In the example above, this information could provide more information about the movie or television show, and, for example, information 138 could complete the information provided by information segment 132 in a different way than is done by information segment 130.

Referring to FIGS. 7, 8 and 9, there is shown another embodiment of the invention. This embodiment is somewhat similar to that of FIGS. 1 and 2 but instead of the device being comprised of two sleeves and a single slider member, the device 140 of this embodiment employs a single sleeve member 142 formed by a pair of outside panels 142*a* and 142*b* and a central or intermediate panel 142*c* (see FIG. 5) and a pair of slide members 144 and 146 which are pulled out from opposite sides of sleeve member 142.

Central panel 142*c* divides the interior of sheath member 142 into two interior spaces and the slide members 144 and 146 are received in the respective spaces and are separated from each other by central panel 142*c*. Although it would be possible to dispense with the central panel 142*c* so that slide members 144 and 146 are in direct contact, the illustrated embodiment is preferred.

Sleeve member 142 includes pairs of transversely spaced end stops at both ends thereof, i.e., stops for both of the interior spaces at both ends, with three of the four end stops being indicated at 148 in FIG. 7 and the other end stop 148 being shown in FIG. 8.

The two slide members 144 and 146 also include respective stops, denoted 150 (see FIGS. 7 and 8) and 152 (see FIG. 7 and stop 152 revealed by breaking away a portion of slide member 144) at the inside ends thereof which cooperate with stops 148 to limit the lateral movement of slide members 144 and 146 beyond sheath member 142 in a similar manner to that described above for, e.g., single slide 88.

As indicated in FIG. 8, panel 142*a* includes information 154 thereon, indicated by the letter "A," and slide members 144 and 146 also include respective information 156 and 158 thereon, indicated by the letters B and C. As above, in a preferred embodiment, all of the information would be related, and the information 156 and 158 on the slide members 144 and 146 would preferably complement and/or complete the information 154 on panel 142.

It will be appreciated that the embodiment of FIGS. 7, 8 and 9 can incorporate features of the embodiments of FIGS.

Figure 10:
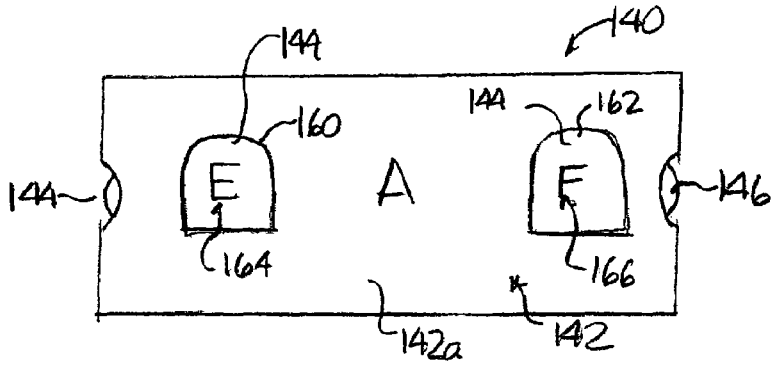
FIGS. 10 and 11 are top plan views of a modified version of the embodiment of FIGS. 7 to 9.
Figure 11:
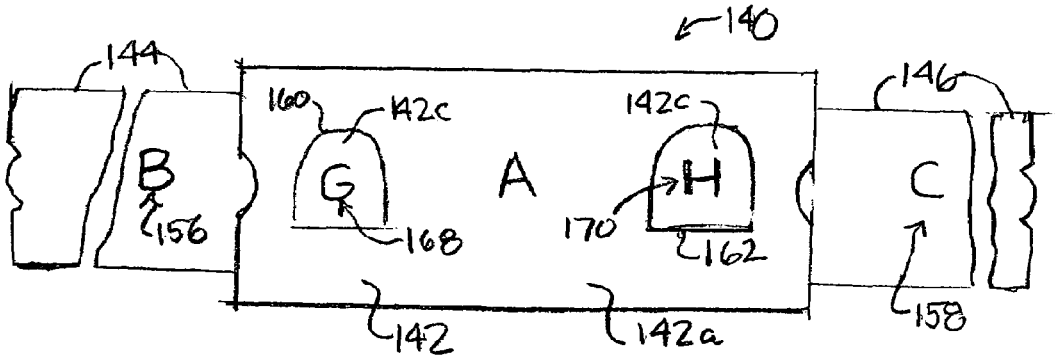

3 and 4 and FIGS. 5 and 6, as can the embodiment of FIGS. 1 and 2. For example, referring to FIGS. 10 and 11, in an embodiment otherwise similar to that of FIGS. 7 to 9, openings or windows 160 and 162, which generally correspond to openings or windows 84 and 86 of the embodiment of FIGS. 3 and 4, are provided in outside panel 142*a* of sheath 142. Thus, similarly to the embodiment of FIGS. 3 and 4, information items E and F, denoted 164 and 166, respectively, appear in, i.e., are viewable through, openings 160 and 162 in the closed position of device 140, while information items G and H, denoted 168 and 170, respectively, are revealed by, and are viewable through, openings 160 and 162. In this embodiment, information items G and H would be provided on central or intermediate panel 142*c*.

Although the invention has been described above in relation to preferred embodiments thereof, it will be understood by those skilled in the art that variations and modifications can be effected in these preferred embodiments without departing from the scope and spirit of the invention.

What is claimed:

1. A display device comprising:

a planar sheath member including first and second panels secured together so as to define a space therebetween; and first and second slide members disposed in said space, said first slide member being movable between a first position wherein said first slide member is substantially wholly received within said space and a second position wherein at least a portion of said first slide member extends outwardly beyond said sheath member, and said second slide member being movable between a first position wherein said second slide member is substantially wholly received within said space and a second position wherein at least a portion of said second slide member extends outwardly beyond said sheath member, said sheath member including first and second inner side walls defining a channel in which said slide members slide and further including, at each of the opposite ends of said channel, first and second sets of first and second stops extending into said channel from opposite sides of said side walls, and said first and second slide members each including first and second stop elements on opposite sides thereof for, upon movement of said slide members to said second position, engaging said stop elements of respective ones of said first and second sets of said stop elements to limit sliding movement of the corresponding slide member, said sheath member further comprising a fixed opaque central panel, located between and extending parallel to, said first and second panels, said first and second inner side walls including the first and second sets of first and second stops, and said first and second slide members, and affixed to the first and second inner sidewalls, and said sheath member including information thereon and said first and second slide members each including related information thereon which is revealed in the second positions of said slide members.

2. A display device as claimed in claim 1 wherein the sheath member displays information which completes information displayed by the slide members.

3. A display device as claimed in claim 1 wherein the information displayed by the sheath member and the information displayed by the slide members includes pictorial information.

4. A display device as claimed in claim 1 wherein the sheath member displays information which complements information displayed by the slide members.

5. A display device as claimed in claim 1 wherein said first panel includes at least one window therein in which a facing portion of at least one of said slide members can be viewed in the first position of the at least one slide member, and through which a facing portion of the central panel of the sheath member can be viewed in the second position of the at least one slide member, said facing portion of the at least one slide member including information thereon which is displayed in the first position of the at least one slide member, and said facing portion of said central panel of the sheath member including information thereon which is displayed in the second position of the at least one slide member.

6. A display device as claimed in claim 5 wherein said information displayed by the respective facing potions is content related.

7. A display device as claimed in claim 5 wherein the information displayed by the respective facing portions relates to a common theme.

8. A display device as claimed in claim 5 wherein the first panel of said sheath member displays information which complements information displayed by the facing portion of said slide member.

9. A display device as claimed in claim 5 wherein the first panel of said sheath member displays information which completes information displayed by the facing portion of said slide member.

10. A display device as claimed in claim 9 wherein the information displayed by the first panel of the sheath member and the information displayed by the facing portion of the slide member comprise pictorial information.

11. A display device as claimed in claim 5 wherein the first panel of the sheath member displays information which complements information displayed by the facing portion of the second panel of said sheath member.

12. A display device as claimed in claim 5 wherein the first panel of said sheath member displays information which completes information displayed by the facing portion of the second panel of said sheath member.

13. A display device as claimed in claim 12 wherein the information displayed by the first panel of the sheath member and the information displayed by the facing portion of the second panel of the sheath member comprises pictorial information.

14. A display device as claimed in claim 5 wherein said at least one window comprises at least first and second spaced windows and wherein different facing portions of said at least one slide member can be viewed through said first and second windows in the first position of said at least one slide member and different facing portions of the second panel of the sheath member can be viewed through said first and second windows in the second position of said at least one slide member.

15. A display device comprising:

a planar sheath member including first and second panels secured together so as to define a space therebetween; and first and second slide members disposed in said space, said first slide member being movable between a first position wherein first said slide member is substantially wholly received within said space and a second position wherein at least a portion of said first slide member extends outwardly beyond said sheath member, and said second slide member being movable between a first position wherein said second slide member is substantially wholly received within said space and a second position wherein at least a portion of said second slide member extends outwardly beyond said sheath member, said sheath member including first and second inner side walls defining a channel in which said slide members slide and further including, at each of the opposite ends of said channel, first and second sets of first and second stops extending into said channel from opposite sides of said side walls, and said first and second slide members each including first and second stop elements on opposite sides thereof for, upon movement of said slide members to said second position, engaging said stop elements of respective ones of said first and second sets of said stop elements to limit sliding movement of the corresponding slide member, and at least one of said panels including at least one window therein through which information provided on at least one slide member can be viewed in the first position of the at least one slide member and through which different, related information can be viewed in the second position of the at least one slide member, said sheath member further comprising an opaque central located between, and extending parallel to, said first and second panels, said first and second inner sidewalls defining said first and second sets of first and second stops, and said first and second slide members, and affixed to said first and second inner side walls of said sheath, and said further information is provided on said central panel.

16. A display device as claimed in claim 15 wherein said sheath member includes information thereon and said first and second slide members each include further information thereof which is related to the information on the sheath member and which is revealed in the second positions of said slide members.

* * * * *